US011125431B2

(12) United States Patent
Umair et al.

(10) Patent No.: US 11,125,431 B2
(45) Date of Patent: Sep. 21, 2021

(54) FLARE SPILL PROTECTION

(71) Applicant: Saudi Arabian Oil Company, Dhahran (SA)

(72) Inventors: Mohammad A. Umair, Dhahran (SA); Ossama R. Sehsah, Dhahran (SA); Mahmoud Adnan Alqurashi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 197 days.

(21) Appl. No.: 16/459,132

(22) Filed: Jul. 1, 2019

(65) Prior Publication Data

US 2021/0003280 A1 Jan. 7, 2021

(51) Int. Cl.

| | |
|---|---|
| ***F23G 7/05*** | (2006.01) |
| ***E21B 41/00*** | (2006.01) |
| ***F23G 7/08*** | (2006.01) |

(52) U.S. Cl.

CPC ..... *F23G 7/05* (2013.01); *E21B 41/0071* (2013.01); *F23G 7/085* (2013.01)

(58) Field of Classification Search

CPC ..... F23G 7/05; F23G 7/085
USPC ..... 431/202, 253
See application file for complete search history.

(56) References Cited

U.S. PATENT DOCUMENTS

| | | | | |
|---|---|---|---|---|
| 3,120,260 A * | 2/1964 | Thompson | ..... | F23G 7/08 239/273 |
| 3,807,932 A | 4/1974 | Dewald | | |
| 4,516,932 A | 5/1985 | Chaudot | | |
| 5,057,004 A * | 10/1991 | McAllister | ..... | F23G 7/05 431/202 |
| 2014/0272739 A1* | 9/2014 | Hurley | ..... | B01D 45/08 431/253 |

FOREIGN PATENT DOCUMENTS

| | | |
|---|---|---|
| KR | 20170050280 | 5/2017 |

OTHER PUBLICATIONS

PCT International Search Report and Written Opinion in International Appln. No. PCT/US2020/040120, dated Oct. 9, 2020, 23 pages.

* cited by examiner

*Primary Examiner* — Avinash A Savani
(74) *Attorney, Agent, or Firm* — Fish & Richardson P.C.

(57) ABSTRACT

An offshore spill protection system includes a flare boom configured to connect to an offshore drilling rig. The flare boom is configured to flare at least a portion of hydrocarbons flowed from the offshore drilling rig to the flare boom. A liquid hydrocarbon capture system includes a plate configured to be spatially positioned relative to the flare boom. The plate is sized to collect at least unflared hydrocarbons in a liquid state that flow through the flare boom.

18 Claims, 4 Drawing Sheets

FLARE SPILL PROTECTION

TECHNICAL FIELD

This disclosure relates to spill protection as it relates to gas flaring.

BACKGROUND

A gas flare is a gas combustion device. Gas flares can be used for burning off flammable gas, either as a way to dispose of the gas or as a safety measure to relieve pressure during planned or unplanned over-pressuring of equipment. Gas flares can be installed on many places, such as onshore and offshore platforms, production fields, transport ships, port facilities, storage tank farms, and along distribution pipelines.

SUMMARY

This disclosure describes technologies relating to spill protection as it relates to gas flaring, and in particular, to offshore gas flaring.

Certain aspects of the subject matter described can be implemented as an offshore hydrocarbon management system. The system includes a flare boom configured to connect to an offshore drilling rig. The flare boom is configured to flare at least a portion of hydrocarbons flowed from the offshore drilling rig to the flare boom. A liquid hydrocarbon capture system includes a plate configured to be spatially positioned relative to the flare boom. The plate is sized to collect at least unflared hydrocarbons in a liquid state that flow through the flare boom.

An aspect combinable with any of the other aspects can include the following features. The liquid hydrocarbon capture system includes a container defining an interior volume. The plate is attached to a surface of the container. The container is configured to receive, within the interior volume, the unflared hydrocarbons in the liquid state collected by the plate.

An aspect combinable with any of the other aspects can include the following features. The system includes a liquid hydrocarbon flow system fluidically coupled to the liquid hydrocarbon capture system. The liquid hydrocarbon flow system is configured to flow the unflared hydrocarbons in the liquid state away from the container of the liquid hydrocarbon capture system.

An aspect combinable with any of the other aspects can include the following features. The liquid hydrocarbon flow system includes a pump and a flowline fluidically coupled to the container. The pump is configured to flow the unflared liquid hydrocarbons in the liquid state from the container through the flowline.

An aspect combinable with any of the other aspects can include the following features. The pump is a suction pump.

An aspect combinable with any of the other aspects can include the following features. The liquid hydrocarbon flow system includes a storage tank configured to receive the unflared liquid hydrocarbons in the liquid state drawn by the pump through the flowline from the container.

An aspect combinable with any of the other aspects can include the following features. The liquid hydrocarbon capture system is fluidically coupled to the flare boom and configured to flow at least a portion of the unflared hydrocarbons in the liquid state to the flare boom to be flared.

An aspect combinable with any of the other aspects can include the following features. The liquid hydrocarbon capture system includes an arm configured to be attached to the offshore drilling rig at a first end. The plate is attached to the arm at a second end of the arm opposite the first end.

An aspect combinable with any of the other aspects can include the following features. The plate is configured to pivot vertically, horizontally, or both vertically and horizontally about the second end of the arm.

An aspect combinable with any of the other aspects can include the following features. The liquid hydrocarbon capture system includes a motor connected to the second end of the arm. The motor is connected to the plate and configured to pivot the plate vertically, horizontally, or both vertically and horizontally about the second end of the arm.

Certain aspects of the subject matter described here can be implemented as a liquid hydrocarbon capture system. The system includes an arm configured to be positioned below a flare boom of an offshore drilling rig and attached to the offshore drilling rig at a first end. The arm includes a second end. The flare boom is configured to flare at least a portion of hydrocarbons flowed from the offshore drilling rig to the flare boom. A plate is attached to the second end. The plate is configured to be spatially positioned relative to the flare boom. The plate is sized to collect at least unflared hydrocarbons in a liquid state that flow through the flare boom.

An aspect combinable with any of the other aspects can include the following features. The system includes a container that defines an interior volume. The plate is attached to a surface of the container. The container is configured to receive, within the interior volume, the unflared hydrocarbons in the liquid state collected by the plate.

An aspect combinable with any of the other aspects can include the following features. The plate defines a port through which the unflared hydrocarbons in the liquid state flow from the plate into the container.

An aspect combinable with any of the other aspects can include the following features. The system includes a liquid hydrocarbon flow system configured to flow the unflared hydrocarbons in the liquid state away from the container.

An aspect combinable with any of the other aspects can include the following features. The liquid hydrocarbon flow system includes a pump and a flowline fluidically coupled to the container. The pump is configured to flow the unflared liquid hyrocarbons in the liquid state from the container through the flowline.

An aspect combinable with any of the other aspects can include the following features. The pump is a suction pump.

An aspect combinable with any of the other aspects can include the following features. The system includes a storage tank fluidically coupled to the liquid hydrocarbon flow system. The storage tank is configured to receive the unflared liquid hydrocarbons in the liquid state drawn by the pump through the flowline from the container.

An aspect combinable with any of the other aspects can include the following features. The liquid hydrocarbon flow system is fluidically coupled to the flare boom and configured to flow at least a portion of the unflared hydrocarbons in the liquid state to the flare boom to be flared.

An aspect combinable with any of the other aspects can include the following features. The plate is configured to pivot vertically or horizontally about the second end of the arm.

An aspect combinable with any of the other aspects can include the following features. The system includes a motor connected to the second end of the arm. The motor is connected to the plate and configured to pivot the plate vertically or horizontally about the second end of the arm.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes spill protection as it relates to gas flaring, and in particular, to offshore gas flaring. In some cases, not all of the fluid flowed to a flare boom connected to an offshore drilling rig gets flared. In other words, the flaring can sometimes not be completely efficient, and some of the fluid flowed to the flare boom may remain unflared. This could occur due to attempts to flare heavy density or API oil, poor maintenance of flare booms resulting in leaks, inefficient flaring caused, for example, by mixing flame, air and hydrocarbons under flaring conditions that are not optimum, slugging in flare boom due to variance in fluids coming out of the well, limitations in equipment, for example, air pressure drop or pump pressure or flow fluctuation, any combination of them, or other reasons. Unflared fluid can fall from the flare boom in a liquid state. If not handled, the unflared liquid may fall into the body of water (referred to as liquid fallout) in which the offshore rig is positioned. The systems described can be used to catch and collect any unflared liquid in order to avoid such liquid fallout. The collected unflared liquid can be, for example, stored in a storage tank, recirculated to the flare for flaring, or a combination of both.

The subject matter described in this disclosure can be implemented in particular implementations, so as to realize one or more of the following advantages. Any potential liquid fallout due to inefficient flaring can be captured, for example, by a plate that is positioned below the flare boom. Therefore, liquid fallout (for example, spilling into the sea) can be prevented. In some implementations, at least a portion of this captured unflared liquid can be stored. In some implementations, at least a portion of this captured unflared liquid can be flowed back to the flare for flaring. The plate can be sloped to facilitate capture of unflared liquid. The plate can be motorized, such that the position of the plate can be altered. The position of the plate can be altered (for example, adjusted in slope or in a different direction) to account for wind direction, which can affect flaring operations. The systems described can be assembled and disassembled offshore on the rig. The systems described can improve safety of flaring operations and mitigate risks associated with flaring operations.

Figure 1A:
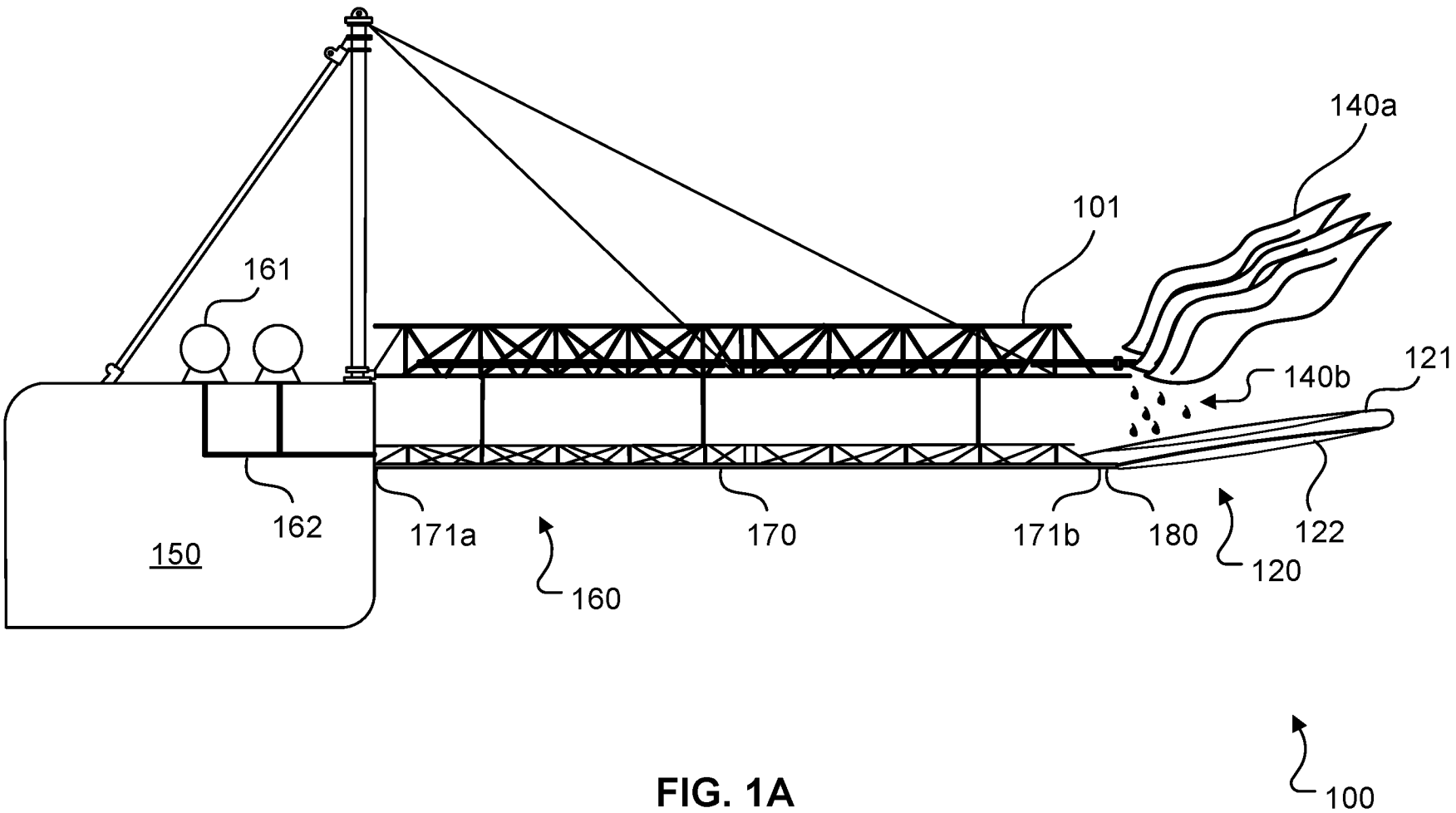
FIG. 1A is a schematic diagram of an example offshore hydrocarbon management system.

FIG. 1A is a schematic diagram of an example offshore hydrocarbon management system 100. The offshore hydrocarbon management system 100 can be used to flare fluids, for example, waste gas which can include hydrocarbons. The offshore hydrocarbon management system 100 includes a flare boom 101 and a liquid hydrocarbon capture system 120. The flare boom 101 is configured to connect to an offshore drilling rig 150. The offshore drilling rig can be any rig that is to be located offshore for any one or more of the following purposes: exploring a rock formation located beneath a seabed for hydrocarbons, producing the hydrocarbons from the rock formation, storing the produced hydrocarbons, and processing the produced hydrocarbons.

The flare boom 101 is configured to flare at least a portion of fluids (such as hydrocarbons) flowed from the offshore drilling rig 150 to the flare boom 101. For example, in the case where crude oil is extracted and produced from an oil well, natural gas may also be produced. Where pipelines or other gas transportation infrastructure (for example, an offshore rig, such as the offshore drilling rig 150) to transport such natural gas, the natural gas is typically flared (for example, using the flare boom 101) as waste or unusable gas. Ideally, all of the fluids flowed to the flare boom 101 are flared, that is, burned off. As mentioned previously, however, in some cases, not all of the fluids flowed to the flare boom 101 get flared. Any unflared fluids may either be released from the flare boom 101 as a gas 140*a* (that has not been combusted) into the atmosphere. In some cases, liquid is flowed to the flare boom 101. For example, flaring is performed when testing a well and its production rate, when getting the well ready for production or meeting production rate, during well control, or any combination of them. Sometimes, return from the well is taken to the flare boom for storage, for example, in offshore rigs or when handling the hydrocarbon can be a challenge due to the presence of undesirable gases like hydrogen sulfide. In such cases, not all of the liquid flowed to the flare boom 101 may get flared and escape the flare boom 101 as a liquid 140*b*, which can fall from the flare boom 101.

The liquid hydrocarbon capture system 120 includes a plate 121 that is configured to be spatially positioned relative to the flare boom 101. For example, the plate 121 can be positioned below the flare boom 101 so that unflared liquid falling from the flare boom 101 can be captured. The plate 121 can be sized to collect at least any unflared hydrocarbons in a liquid state (140*b*) that flow through the flare boom 101. The plate 121 can optionally be sized to catch and collect unflared hydrocarbons in a liquid state (140*b*) that may be sprayed (for example, spewed) from the flare boom 101. The plate 121 can be made of a material that is resistant to the hot fluid falling from the flare boom 101. For example, the plate 121 can be made of a high-temperature resistant and high corrosion resistant alloy that can handle hydrocarbons and chemicals.

The liquid hydrocarbon capture system 120 can include a container 122 that defines an interior volume. The plate 121 can be attached to (or be an integral portion) of a surface of the container 122. The container 122 can be configured to receive within the interior volume, the unflared hydrocarbons in the liquid state 140*b* collected by the plate 121.

The offshore hydrocarbon management system 100 can include a liquid hydrocarbon flow system 160 that is fluidically coupled to the liquid hydrocarbon capture system 120. The liquid hydrocarbon flow system 160 can be configured to flow the unflared hydrocarbons in the liquid state 140*b* away from the container 122 of the liquid hydrocarbon capture system 120. The liquid hydrocarbon flow system 160 can include a pump 161 and a flowline 162 fluidically coupled to the container 122. The pump 161 can be configured to flow the unflared liquid hydrocarbons in the liquid state 140*b* from the container 122 through the flowline 162. In some implementations, the pump 161 is a suction pump or any other oil and gas rated pump. As shown in FIG. 1A, the liquid hydrocarbon flow system 160 can include more than one pump 161. For example, the liquid hydrocarbon flow system 160 can include multiple pumps 161 in series, in parallel, or a combination of both. Similarly, the liquid hydrocarbon flow system 160 can include more than one flowline 162. For example, the liquid hydrocarbon flow system 160 can include multiple flowlines 162 (for example, a network of flowlines 162). Another example of the liquid hydrocarbon flow system 160 is shown in FIGS. 1B and 1*s* described in more detail later.

The liquid hydrocarbon capture system 160 can include an arm 170 configured to be attached to the offshore drilling rig 150 at a first end 171*a*. The plate 121 can be attached to the arm 170 at a second end 171*b* opposite the first end 171*a*. A portion of the flowline 162 (or network of flowlines 162) can run along the arm 170. In some implementations, a portion of the flowline 162 (or network of flowlines 162) is disposed within the arm 170. In some implementations, a portion of the flowline 162 (or network of flowlines 162) is disposed on top of the arm 170. For example, the portion of the flowline 162 (or network of flowlines 162) can be disposed between the arm 170 and the flare boom 101. In some implementations, the arm 170 can be attached to the flare boom 101. In some implementations, the arm 170 can be moveable with the flare boom 101. In some implementations, the arm 170 is detachable from the flare boom 101. In some implementations, the arm 170 is detachable from the plate 121.

Figure 1B:
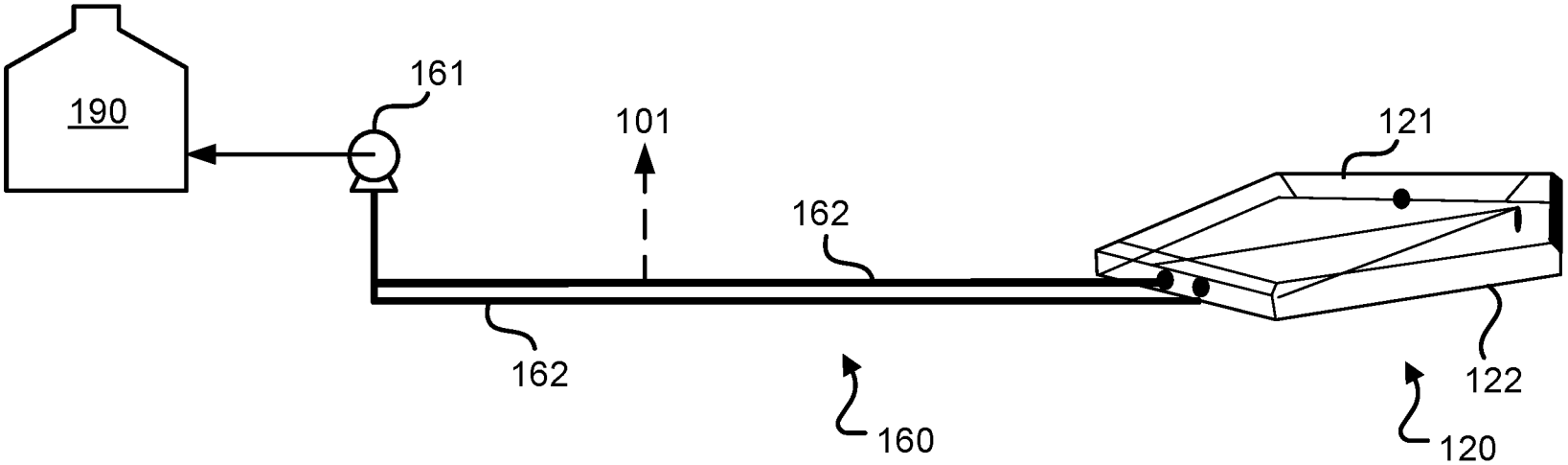
FIG. 1B is a schematic diagram of an example liquid hydrocarbon capture system of the offshore hydrocarbon management system shown in FIG. 1A.

FIG. 1B is a schematic diagram of an example of the liquid hydrocarbon capture system 120. The plate 121 can define a port 121*a* through which unflared hydrocarbons in the liquid state 140*b* (collected by the plate 121) can drain into the container 122. Although shown in FIG. 1B as defining one port 121*a*, the plate 121 can optionally define multiple ports 121*a*.

The container 122 can define a port 122*a* through which unflared hydrocarbons in the liquid state 140*b* can flow from the container 122 to the flowline 162 (or network of flowlines 162). Although shown in FIG. 1B as defining two ports 122*a*, the container 122 can define one port 122*a* or more than two ports 122*a* (for example, three or more ports 122*a*). The number of ports 122*a* can be based on the number of flowlines 162 coupled to the container 122. For example, each port 122*a* can be designated for a respective flowline 162 coupled to the container 122.

The liquid hydrocarbon capture system 120 can include a storage tank 190. The storage tank 190 can be positioned on the offshore drilling rig 150. The storage tank 190 can be configured to receive and store the unflared liquid hydrocarbons in the liquid state 140*b* drawn by the pump 161 through the flowline 162 (or network of flowlines 162) from the container 122. The unflared liquid hydrocarbons in the storage tank 190 can be processed using any typical surface equipment operated during flaring operation or sent to a facility for handling hydrocarbon waste, for example, a mud plant or a gas oil separator plant (GOSP). In this manner, the storage tank 190 can collect and protect the environment from the unburnt hydrocarbons.

In some implementations, the liquid hydrocarbon capture system 160 is fluidically coupled to the flare boom 101. For example, the network of flowlines 162 can include one or more flowlines 162 coupled to the flare boom 101 (dotted arrow), such that at least a portion of the unflared hydrocarbons in the liquid state 140*b* can be flowed back to the flare boom 101 to be flared.

Figure 2A:
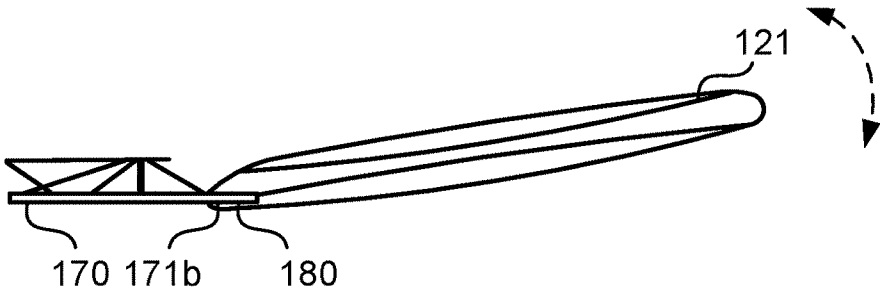
FIG. 2A is a side view of an example plate of the offshore hydrocarbon management system shown in FIG. 1A.

FIG. 2A is a side view of the plate 121. As mentioned previously, the plate 121 can be attached to the arm 170 at its second end 171*b*. The plate 121 can be configured to pivot vertically, horizontally, or both vertically and horizontally about the second end 171*b* of the arm 170. In some implementations, the liquid hydrocarbon capture system 160 includes a motor 180 connected to the second end 171*b* of the arm 170 and to the plate 121. The motor 180 can be configured to pivot the plate 121 vertically, horizontally, or both vertically and horizontally about the second end 171*b* of the arm 170. In some implementations, a ball joint (not shown) connects the motor 180 to the plate 121, and the plate 121 can pivot about the ball joint while the motor 180 controls the pivoting position of the plate 121 about the ball joint. The pivoting position of the plate 121 can be adjusted to a favorable position to capture fallout from the flare boom 101. For example, if a change in wind direction is detected, then the plate 121 can be pivoted to a position that would maximize the chance of catching any fallout from the flare boom 101 (for example, in the direction of the wind). In this manner, the plate 121 can be turned based on wind direction to catch any unburnt hydrocarbons. The plate 121 can also be inclined to avoid flooding of the plate if large quantities of hydrocarbons drop. Inclining the plate 121 can also help the fluid to be recovered based on operational requirements.

Figure 2B:
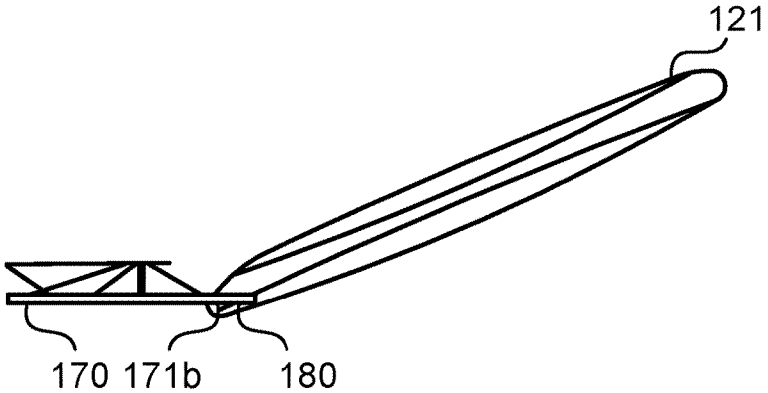
FIG. 2B is a side view of the plate shown in FIG. 2A pivoted upward.
Figure 2C:
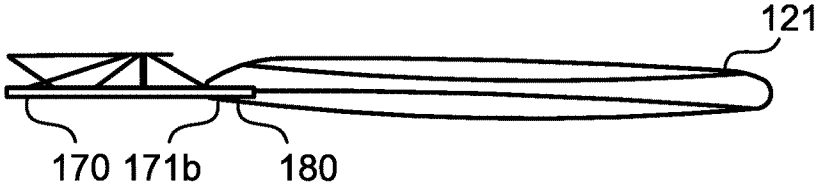
FIG. 2C is a side view of the plate shown in FIG. 2A pivoted downward.
Figure 3A:
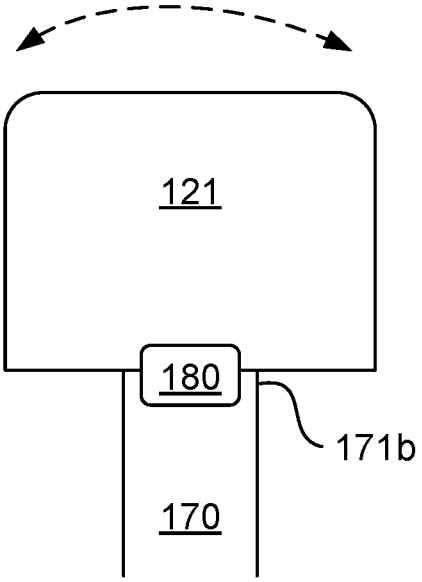
FIG. 3A is a top view of an example plate of the offshore hydrocarbon management system shown in FIG. 1A.
Figure 3B:
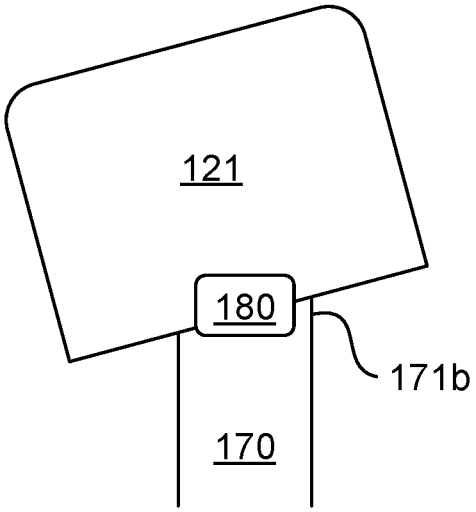
FIG. 3B is a top view of the plate shown in FIG. 3A pivoted to the left.
Figure 3C:
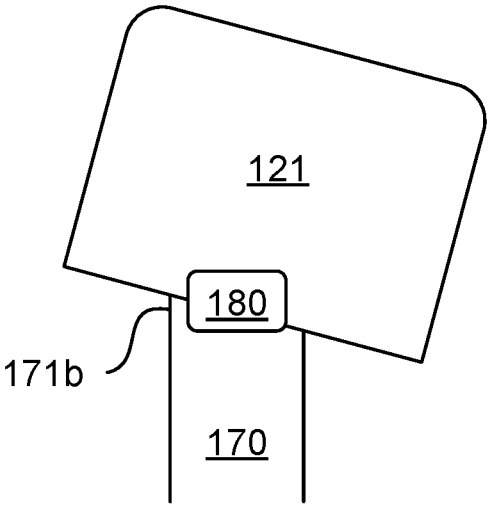
FIG. 3C is a top view of the plate shown in FIG. 3A pivoted to the right.

FIG. 2B is a side view of the plate 121 pivoted vertically upward (for example, toward the flare boom 101), and FIG. 2C is a side view of the plate 121 pivoted vertically downward (for example, away from the flare boom 101). FIG. 3A is a top view of the plate 121. FIG. 3B is a top view of the plate 121 pivoted horizontally to the left in relation to the direction of the arm 170 pointing outward from the offshore drilling rig 150. FIG. 3C is a top view of the plate 121 pivoted horizontally to the right in relation to the direction of the arm 170 pointing outward from the offshore drilling rig 150. As mentioned previously, the plate 121 can be pivoted both vertically and horizontally. For example, the plate 121 can be pivoted vertically upward and horizontally to the left. For example, the plate 121 can be pivoted vertically upward and horizontally to the right. For example, the plate 121 can be pivoted vertically downward and horizontally to the left. For example, the plate 121 can be pivoted vertically downward and horizontally to the right.

Although shown in FIGS. 3A through 3C as having a generally rectangular shape, the plate 121 can have any shape, as long as the plate 121 is appropriately sized for capturing any unflared fluids falling from the flare boom 101.

The flare boom 101 and the liquid hydrocarbon capture system 160 are each configured to connect to the offshore drilling rig 150. In some implementations, the flare boom 101 is constructed as part of the offshore drilling rig 150 (that is, the flare boom 101 can be integral to the offshore drilling rig 150). In some implementations, the flare boom 101 is constructed separately from the offshore drilling rig 150 and then connected to the offshore drilling rig 150. Similarly, in some implementations, the liquid hydrocarbon capture system 160 is constructed as part of the offshore drilling rig 150, while in other implementations, the liquid hydrocarbon capture system 160 is constructed separately from the offshore drilling rig 150 and then connected to the offshore drilling rig 150. The flare boom 101 and the liquid hydrocarbon capture system 160 can be designed for the same design conditions (that is, design pressures and temperatures).

Although not shown in the figures, the offshore hydrocarbon management system 100 can also include a backup treatment system that can be configured to pump a treatment fluid into the body of water located below the flare boom 101 and the plate 121 of the liquid hydrocarbon capture system 120. This backup treatment system can be used for remedial purposes, especially in cases where the plate 121 was not able to capture all of the fallout from the flare boom 101. Such cases may occur, for example, when the plate 121 is flooded (for example, due to plugging in the flowline 162 or the rate of liquid 140*b* falling from the flare boom 101 exceeds the rate at which liquid 140*b* drains into the container 122), late shut-in of a well, spot flaring operations, or a change in wind direction or speed, resulting in fallout from the flare boom 101 outside the range of the plate 121

Although described in relation to an offshore rig, the systems described in this disclosure can also be implemented in other facilities that include a flare. For example, the liquid hydrocarbon capture system 120 can be implemented on a flare where liquid fallout is possible (not necessarily on an offshore rig).

In this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

In this disclosure, "approximately" means a deviation or allowance of up to 10 percent (%) and any variation from a mentioned value is within the tolerance limits of any machinery used to manufacture the part. Likewise, "about" can also allow for a degree of variability in a value or range, for example, within 10%, within 5%, or within 1% of a stated value or of a stated limit of a range.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

While this disclosure contains many specific implementation details, these should not be construed as limitations on the subject matter or on what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Nevertheless, it will be understood that various modifications, substitutions, and alterations may be made. While operations are depicted in the drawings or claims in a particular order, this should not be understood as requiring that such operations be performed in the particular order shown or in sequential order, or that all illustrated operations be performed (some operations may be considered optional), to achieve desirable results. Accordingly, the previously described example implementations do not define or constrain this disclosure.

What is claimed is:

1. An offshore hydrocarbon management system comprising:

a flare boom configured to connect to an offshore drilling rig, the flare boom configured to flare at least a portion of hydrocarbons flowed from the offshore drilling rig to the flare boom; and a liquid hydrocarbon capture system comprising:

a plate configured to be spatially positioned relative to the flare boom, the plate sized to collect at least unflared hydrocarbons in a liquid state that flow through the flare boom; and a container defining an interior volume, wherein the plate is attached to a surface of the container, and the container is configured to receive within the interior volume, the unflared hydrocarbons in the liquid state collected by the plate.

2. The offshore hydrocarbon management system of claim 1, further comprising a liquid hydrocarbon flow system fluidically coupled to the liquid hydrocarbon capture system, the liquid hydrocarbon flow system configured to flow the unflared hydrocarbons in the liquid state away from the container of the liquid hydrocarbon capture system.

3. The offshore hydrocarbon management system of claim 2, wherein the liquid hydrocarbon flow system comprises:

a pump; and a flowline fluidically coupled to the container, the pump configured to flow the unflared liquid hydrocarbons in the liquid state from the container through the flowline.

4. The offshore hydrocarbon management system of claim 3, wherein the pump is a suction pump.

5. The offshore hydrocarbon management system of claim 3, wherein the liquid hydrocarbon flow system further comprises a storage tank configured to receive the unflared liquid hydrocarbons in the liquid state drawn by the pump through the flowline from the container.

6. The offshore hydrocarbon management system of claim 2, wherein the liquid hydrocarbon capture system is fluidically coupled to the flare boom and configured to flow at least a portion of the unflared hydrocarbons in the liquid state to the flare boom to be flared.

7. The offshore hydrocarbon management system of claim 1, wherein the liquid hydrocarbon capture system further comprises an arm configured to be attached to the offshore drilling rig at a first end, wherein the plate is attached to the arm at a second end of the arm opposite the first end.

8. The offshore hydrocarbon management system of claim 7, wherein the plate is configured to pivot vertically, horizontally, or both vertically and horizontally about the second end of the arm.

9. The offshore hydrocarbon management system of claim 8, wherein the liquid hydrocarbon capture system further comprises a motor connected to the second end of the arm, the motor connected to the plate and configured to pivot the plate vertically, horizontally, or both vertically and horizontally about the second end of the arm.

10. A liquid hydrocarbon capture system comprising:

an arm configured to be positioned below a flare boom of an offshore drilling rig and attached to the offshore drilling rig at a first end, the arm comprising a second end, the flare boom configured to flare at least a portion of hydrocarbons flowed from the offshore drilling rig to the flare boom;

a plate attached to the second end of the arm, the plate configured to be spatially positioned relative to the flare boom, the plate sized to collect at least unflared hydrocarbons in a liquid state that flow through the flare boom; and a container defining an interior volume, wherein the plate is attached to a surface of the container, and the container is configured to receive within the interior volume, the unflared hydrocarbons in the liquid state collected by the plate.

11. The liquid hydrocarbon capture system of claim 10, wherein the plate defines a port through which the unflared hydrocarbons in the liquid state flow from the plate into the container.

12. The liquid hydrocarbon capture system of claim 11, further comprising a liquid hydrocarbon flow system configured to flow the unflared hydrocarbons in the liquid state away from the container.

13. The liquid hydrocarbon capture system of claim 12, wherein the liquid hydrocarbon flow system comprises:

a pump; and a flowline fluidically coupled to the container, the pump configured to flow the unflared liquid hydrocarbons in the liquid state from the container through the flowline.

14. The liquid hydrocarbon capture system of claim 13, wherein the pump is a suction pump.

15. The liquid hydrocarbon capture system of claim 13, further comprising a storage tank fluidically coupled to the liquid hydrocarbon flow system, the storage tank configured to receive the unflared liquid hydrocarbons in the liquid state drawn by the pump through the flowline from the container.

16. The liquid hydrocarbon capture system of claim 11, wherein the liquid hydrocarbon flow system is fluidically coupled to the flare boom and configured to flow at least a portion of the unflared hydrocarbons in the liquid state to the flare boom to be flared.

17. The liquid hydrocarbon capture system of claim 10, wherein the plate is configured to pivot vertically or horizontally about the second end of the arm.

18. The liquid hydrocarbon capture system of claim 17, further comprising a motor connected to the second end of the arm, the motor connected to the plate and configured to pivot the plate vertically or horizontally about the second end of the arm.

* * * * *